US005579928A

United States Patent [19]

Anukwuem

[11] Patent Number: 5,579,928

[45] Date of Patent: Dec. 3, 1996

[54] TEST TUBE HOLDER WITH LOCK DOWN CLAMP

[76] Inventor: Chidi I. Anukwuem, 7 Newman Pl., East Hanover, N.J. 07936

[21] Appl. No.: 398,903

[22] Filed: Mar. 6, 1995

[51] Int. Cl.[6] ..... A47F 7/00

[52] U.S. Cl. ..... 211/74; 211/89; 211/75; 422/104; 206/443

[58] Field of Search ..... 211/74, 75, 89; 248/312.1, 313; 422/104, 99; 206/443, 446

[56] References Cited

U.S. PATENT DOCUMENTS

| | | | |
|---|---|---|---|
| 3,390,783 | 7/1968 | Quackenbush, Jr. . | |
| 3,650,381 | 3/1972 | Weindling . | |
| 3,744,665 | 7/1973 | Spoto . | |
| 4,585,119 | 4/1986 | Boyington | 211/74 X |
| 4,787,523 | 11/1988 | Kalous . | |
| 5,080,232 | 1/1992 | Leoncavallo et al. . | |
| 5,137,693 | 8/1992 | Mawhirt . | |
| 5,148,919 | 9/1992 | Rubin . | |
| 5,322,668 | 7/1994 | Tomasso . | |
| 5,378,433 | 1/1995 | Duckett et al. | 206/443 X |

FOREIGN PATENT DOCUMENTS

| | | |
|---|---|---|
| 1522057 | 3/1968 | France . |
| 986243 | 3/1965 | United Kingdom . |

*Primary Examiner*—Robert W. Gibson, Jr.
*Attorney, Agent, or Firm*—Richard M. Goldberg

[57] ABSTRACT

A test tube holder for holding a test tube having an upper lip, includes a holder ring having an opening therein through which the test tube can be inserted; and a lock down clamp secured to the holder and including a lock down member movable over the holder and over the upper lip of the test tube, a moving assembly connected between the lock down member and the holder for moving the lock down member between a locking position in blocking relation to movement of the test tube out of the holder, and a release position out of the blocking relation, the moving assembly including a lever arm pivotally connected to the holder, the lock down member being fixed to an upper end of the lever arm, a pivoting assembly connected with the holder and to which the lever arm is pivotally connected, and a locking assembly connected with the moving assembly for releasably maintaining the lock down member in the locking position, the locking assembly including a ridge roll member secured to the lever arm, and a ridge on the holder and over which the ridge roll member rides to releasably maintain the lock down member in the locking position.

20 Claims, 3 Drawing Sheets

FIG-1
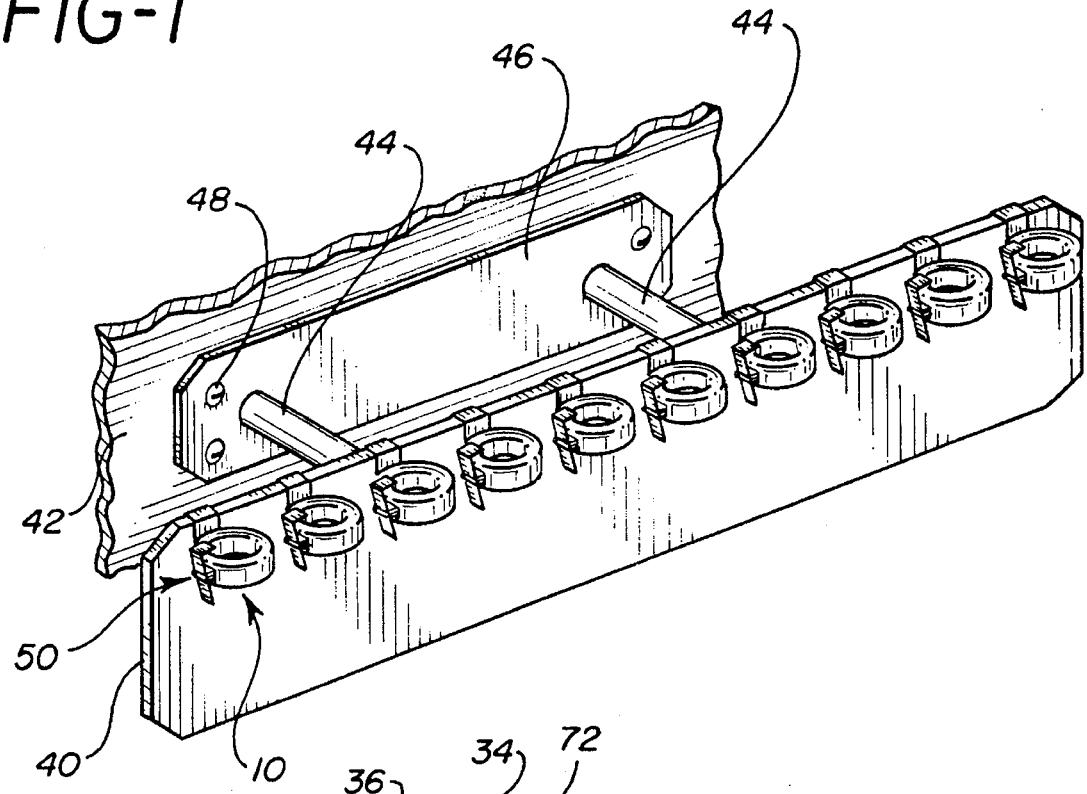
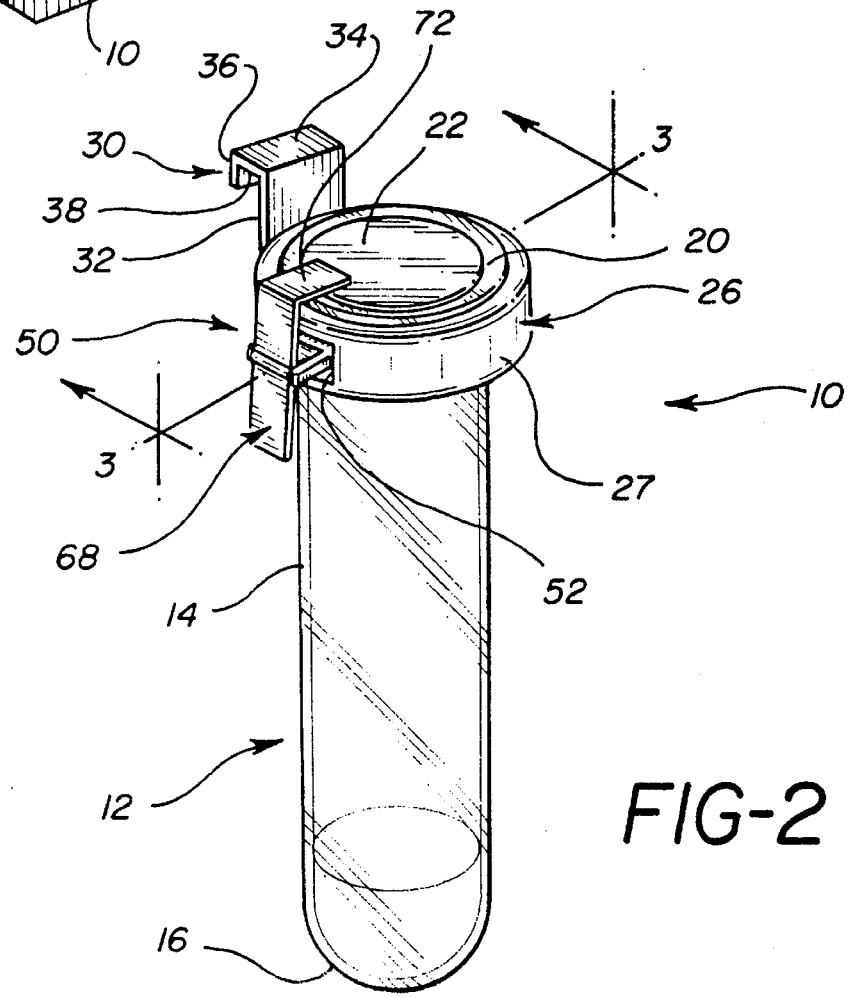
FIG-2

TEST TUBE HOLDER WITH LOCK DOWN CLAMP

BACKGROUND OF THE INVENTION

The present invention relates generally to test tube holders, and more particularly, is directed to a test tube holder with a lock down clamp.

In hospitals, doctors' offices and the like, a phlebotomist, doctor or nurse must often extract blood from a patient while the patient is in bed, and then transfer the blood from the needle to a vacutainer, which is a test tube with a resealable plug at the upper open end of the test tube. Because the phlebotomist, doctor or nurse must hold the test tube in one hand and the needle in the other hand, the possibility of the phlebotomist, doctor or nurse being punctured by the needle presents the problem of the phlebotomist, doctor or nurse being infected with the HIV virus, hepatitis-B virus or the like.

Although various types of test tube holders are known in the art so that a nurse need not hold the test tube during such transfer, such test tube holders are inadequate for the purpose of on-site transfer of blood, for example, at a patient's bedside.

In this regard, test tube holders have openings through which test tubes fit, so as to guide and restrain movement of the test tubes. In such case, the test tubes are supported by their lower ends resting on a bottom surface or base. Thus, there is no stability thereto.

In some cases, it is important that the test tubes be locked in place so that they cannot be removed during certain operations. In this regard, test tube holders are known which engage sides of the test tubes to lock the same. This, however, greatly complicates the construction, while making it difficult to easily and readily remove and reinsert the test tubes. In addition, it is difficult, if not impossible, to permanently affix most test tube holders to a hospital bed or the like for easy and ready access to the test tubes held therein.

OBJECTS AND SUMMARY OF THE INVENTION

Accordingly, it is an object of the present invention to provide a test tube holder with a lock down clamp that overcomes the problems with the aforementioned prior art.

It is another object of the present invention to provide a test tube holder with a lock down clamp which provides easy and ready removal and reinsertion of the test tubes.

It is still another object of the present invention to provide a test tube holder with a lock down clamp that securely locks the test tubes in the holder.

It is yet another object of the present invention to provide a test tube holder with a lock down clamp in which the test tube holder can be permanently affixed to a hospital bed or the like where it is readily accessible.

It is yet another object of the present invention to provide a plurality of said test tube holders mounted to a frame with a lock down clamp associated which each test tube for individually locking down each test tube in its respective test tube holder.

In accordance with an aspect of the present invention, a test tube holder for holding a test tube having an upper lip, includes a holder having an opening therein through which the test tube can be inserted; and a lock down clamp secured to the holder and including a lock down member movable over the holder and over the upper lip of the test tube, and a moving assembly connected between the lock down member and the holder for moving the lock down member between a locking position in blocking relation to movement of the test tube out of the holder, and a release position out of the blocking relation.

Preferably, the holder includes a ring having an opening therein for receiving the test tube therethrough.

The moving assembly includes a lever arm pivotally connected to the holder, and the lock down member is fixed to an upper end of the lever arm. Specifically, a pivoting assembly is connected with the holder and the lever arm is pivotally connected thereto. The pivoting assembly includes two parallel, spaced apart arms extending from the holder, each arm having a free end, and a pivot pin extending between the free ends of the arms, with the lever arm pivotally mounted on the pivot pin. In a preferred embodiment, the holder includes an outer surface with a recess therein, and the arms are connected to the holder in the recess and extend outwardly therefrom.

The lock down clamp further includes a locking assembly connected with the moving assembly for releasably maintaining the lock down member in the locking position. In a preferred embodiment, the locking assembly includes a ridge roll member secured to the lever arm, and a ridge on the holder over which the ridge roll member rides during pivoting of the lever arm, to releasably maintain the lock down member in the locking position.

In accordance with another aspect of the present invention, a test tube holder for holding a test tube having an upper lip, includes a holder having an opening therein through which the test tube can be inserted; and a lock down clamp secured to the holder and including a lock down member movable over the holder and over the upper lip of the test tube, a moving assembly connected between the lock down member and the holder for moving the lock down member between a locking position in blocking relation to movement of the test tube out of the holder, and a release position out of the blocking relation, and a locking assembly connected with the moving assembly for releasably maintaining the lock down member in the locking position.

In accordance with still another aspect of the present invention, a test tube holder for holding a test tube having an upper lip, includes a holder ring having an opening therein through which the test tube can be inserted; and a lock down clamp secured to the holder and including a lock down member movable over the holder and over the upper lip of the test tube, a moving assembly connected between the lock down member and the holder for moving the lock down member between a locking position in blocking relation to movement of the test tube out of the holder, and a release position out of the blocking relation, the moving assembly including a lever arm pivotally connected to the holder, the lock down member being fixed to an upper end of the lever arm, a pivoting assembly connected with the holder and to which the lever arm is pivotally connected, and a locking assembly connected with the moving assembly for releasably maintaining the lock down member in the locking position, the locking assembly including a ridge roll member secured to the lever arm, and a ridge on the holder and over which the ridge roll member rides to releasably maintain the lock down member in the locking position.

In accordance with yet another aspect of the present invention, a test tube holding assembly for holding a plurality of test tubes, each having an upper lip, includes a frame member; a plurality of holder rings, each having an opening therein through which a respective test tube can be inserted; bracket means for securing each holder to the frame member; and a lock down clamp secured to each the holder, each lock down clamp including a lock down member movable over the respective holder and over the upper lip of the respective test tube, a moving assembly connected between the lock down member and the respective holder for moving the lock down member between a locking position in blocking relation to movement of the test tube out of the respective holder, and a release position out of the blocking relation, and a locking assembly connected with each the moving assembly for releasably maintaining the respective lock down member in the locking position.

The above and other objects, features and advantages of the invention will become readily apparent from the following detailed description thereof which is to be read in connection with the accompanying drawings.

BRIEF DESCRIPTION OF THE DRAWINGS

FIG. 1 is a perspective view of a plurality of test tube holders with lock down clamps according to the present invention, mounted on a frame;

FIG. 2 is an enlarged perspective view of one test tube holder and lock down clamp of FIG. 1;

DETAILED DESCRIPTION OF THE PREFERRED EMBODIMENTS

Figure 3:
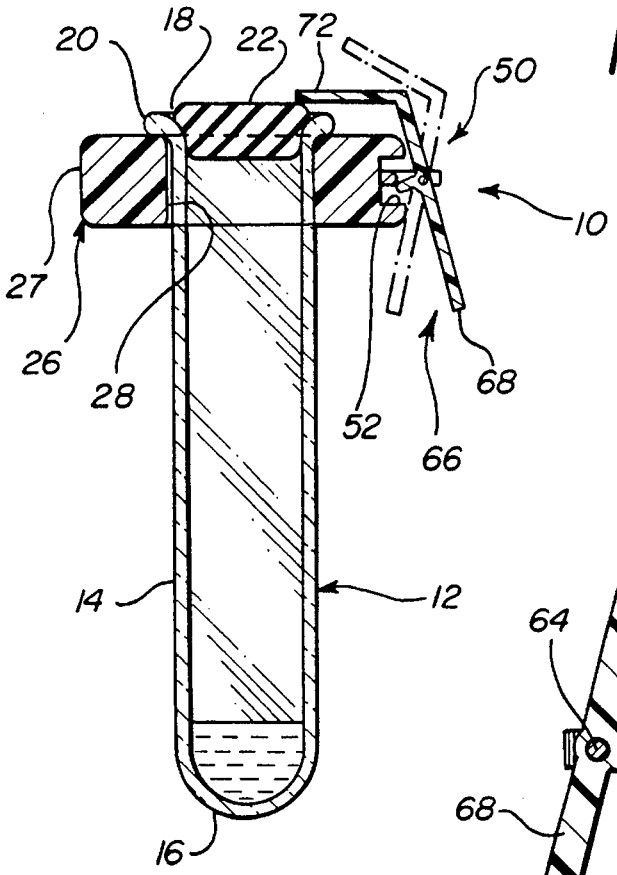
FIG. 3 is a cross-sectional view of the test tube holder of FIG. 2, taken along line 3—3 thereof.

Referring to the drawings in detail, a test tube holder 10 according to the present invention will now be described for holding a conventional glass test tube 12. In this regard, test tube 12 has a generally elongated cylindrical body 14 with a closed, rounded base 16 and an upper open end 18 that terminates in an outwardly flared lip 20. As is known, the upper open end 18 of test tube 12 is closed by a rubber or other sealable plug 22 inserted therein. Sealable plug 22 can be punctured by a needle 24, as shown best in FIGS. 7 and 8, with plug 22 forming a seal about needle 24 therein, and closing the puncture site after needle 24 has been removed. Such an arrangement is conventionally known as a vacutainer.

Test tube holder 10 includes a holder ring 26 having a central opening 28 with a diameter less than that of outwardly flared lip 20 so that outwardly flared lip 20 seats on the upper surface of holder ring 22 for supporting test tube 12 in test tube holder 10, as best shown in FIG. 3. Holder ring 26 is preferably a cushioned ring made of rubber or similar material in order to prevent breakage of glass test tube 12. Of course, it will be appreciated that holder ring 26 need not assume an annular shape, but any supporting means can be provided having an opening 28 therein through which a test tube 12 is inserted and by which the test tube 12 is guided or supported.

As shown best in FIG. 2, an inverted J-shaped bracket 30 includes a long plate 32, a shorter transverse plate 34 connected transversely to the upper edge of long plate 32, and a shorter parallel plate 36 connected to the opposite edge of shorter transverse plate 34 in parallel, spaced relation to long plate 32 so as to define an inverted U-shaped channel 38 at the upper end thereof. The lower end of long plate 32 is fixed to an outer peripheral side 27 of holder ring 26. In this manner, as shown best in FIGS. 1 and 6–8, U-shaped channel 38 is fit over and receives therein the upper edge of a holder panel 40. J-shaped bracket 30 can then be secured to holder panel 40 by any conventional means, such as bolts, adhesives or the like. Accordingly, as shown best in FIG. 1, a plurality of test tube holders 10 according to the present invention can be held on holder panel 40 for holding a plurality of test tubes 12.

Holder panel 40 can be secured, for example, to the side of a hospital bed 42. One manner of accomplishing this is shown in FIG. 1. Specifically, two rods 44 extend outwardly in parallel relation from the rear surface of holder panel 40, that is, on the opposite side from test tube holders 10. A securing plate 46 is secured to the opposite ends of rods 44, in substantially parallel relation to holder panel 40. Securing plate 46 has holes (not shown) therein for receiving bolts 48 in order to fix securing plate 46 to the side of hospital bed 42.

In accordance with the present invention, a lock down clamp 50 is secured to each holder ring 26 in order to releasably secure a test tube 12 therein.

Specifically, a recess 52 is cut out of outer peripheral side 27 of holder ring 26. Recess 52 is angularly spaced from the securement of inverted J-shaped bracket 30 to outer peripheral side, preferably by at least ninety degrees. Lock down clamp 50 includes a hook 54 having a U-shape, that is, formed by two parallel, spaced apart legs 56 and 58 connected together at one end thereof by a connecting leg 60. U-shaped hook 54 is fixed within recess 52 of holder ring 26 such that the open end thereof faces away from holder ring 26, that is, with connecting leg 60 secured to holder ring 26 within recess 52 thereof. It will be appreciated from the discussion hereinafter that hook 54 is fixed centrally within recess 52 to permit pivoting free movement of the remainder of lock down clamp 50. It is further noted that the free edge of connecting leg 60 of U-shaped hook 54 which is positioned between legs 56 and 58, has a ridge 62 which is constituted by a curved or rounded face thereof.

A pivot pin 64 is fixed between the free ends of legs 56 and 60 of hook 54, and a lever clamp 66 is pivotally mounted on pivot pin 64. Lever clamp 66 is comprised of an elongated lever arm 68 having a transverse pin receptor hole 70 at a mid-point thereof which receives pivot pin 64 therein to rotatably or pivotally mount lever arm 68 thereabout. A lock down plate 72 is integrally formed at the upper edge of lever arm 68 and extends inwardly at an angle therefrom towards holder ring 26. Of course, lock down plate 72 can be replaced with a lock down member have any suitable configuration, such as a rod or the like, and the present invention is not limited to a plate.

As will be appreciated from the discussion hereinafter, when test tube 12 is supported within holder ring 26, lever arm 68 can be rotated in the direction of arrow 74 in FIG. 5, whereby lock down plate 72 is rotated with lever arm 68 in the direction of arrow 76 in FIG. 5 to a position above and in contact with test tube 12. Thus, outwardly flared lip 20 of test tube 12 is held between lock down plate 72 and the upper surface of holder ring 26.

In order to releasably restrain lock down plate 72 in this position, lock down clamp 50 further includes a ridge roll plate 78 integrally formed with elongated lever arm 68 at the position of transverse pin receptor hole 70. Ridge roll plate 78 extends inwardly toward holder ring 26 and has a width less than the spacing between legs 56 and 58 of hook 54 so as to move freely therebetween. The length of ridge roll plate 78 is such that the rounded free inner edge 80 thereof extends into engagement with ridge 62 of hook 54, and in fact, extends inwardly a small amount past ridge 62.

Figure 5:
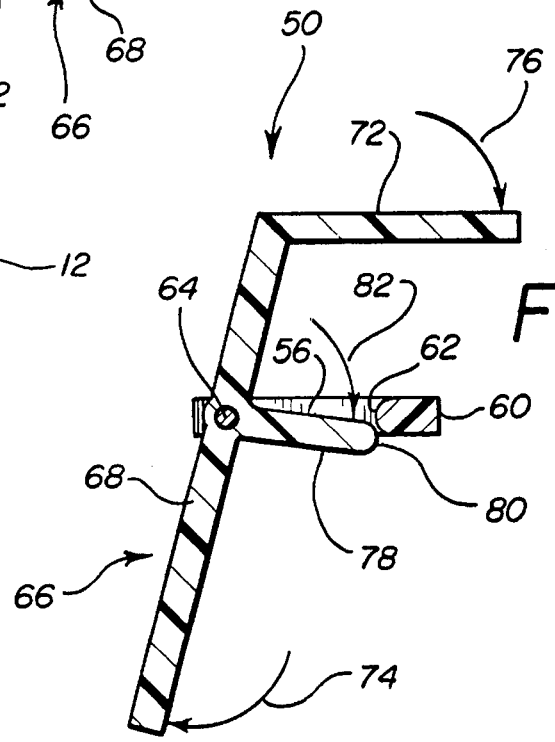
FIG. 5 is a cross-sectional view of the lock down clamp of FIG. 4, in an assembled and operative condition, taken along line 5—5 thereof.
Figure 4:
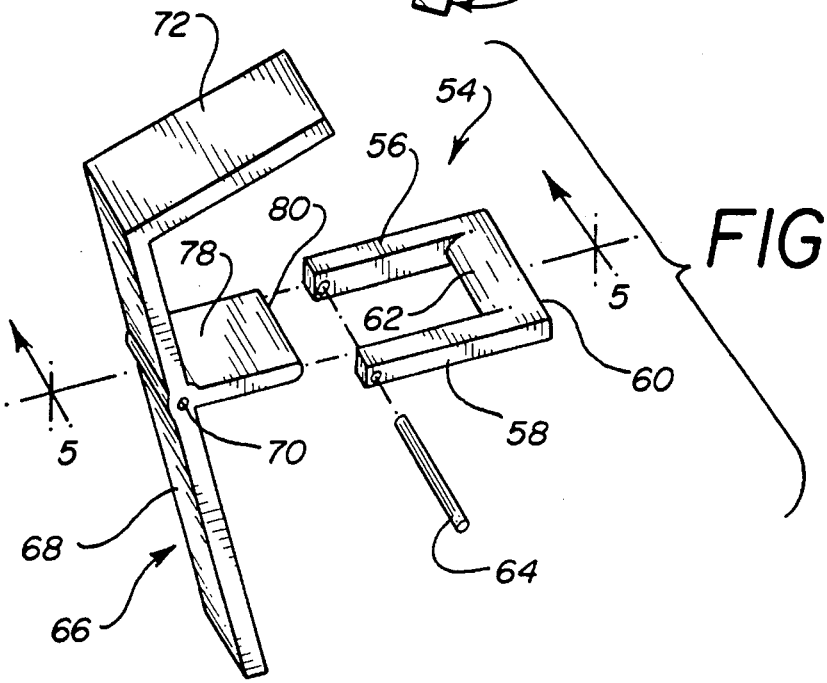
FIG. 4 is an exploded, perspective view of the lock down clamp according to the present invention.
Figure 6:
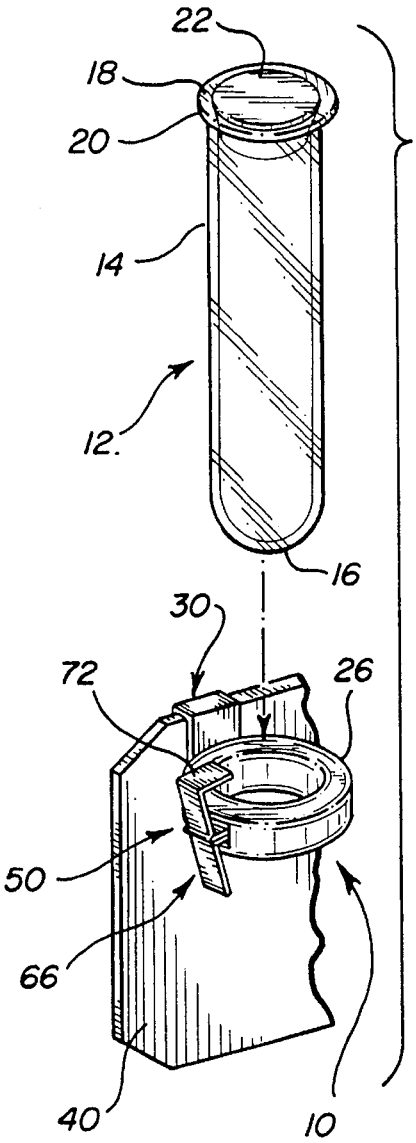
FIG. 6 is an exploded, perspective view of the test tube holder of FIG. 2, with a test tube positioned thereabove for insertion therein.

Accordingly, as shown in FIG. 5, when lever arm 68 is moved in the direction of arrow 74, ridge roll plate 78 moves in the same direction, as indicated by arrow 82 in FIG. 5. Thus, rounded free inner edge 80 of ridge roll plate 78, which is positioned above ridge 62 of hook 54, is forced into engagement with ridge 62, and because of resilient deformation of the plastic material, rides over ridge 62 so as to be positioned slightly under ridge 62, as shown in FIG. 5. In this position, lever arm 68 and lock down plate 72 are releasably locked in the lock down position shown in FIGS. 2, 3, 7 and 8.

To release test tube 12 from the locked state thereof, lever arm 68 is rotated in the opposite direction of arrow 74 to the dashed line position of FIG. 3. As a result, rounded free inner edge 80 of ridge roll plate 78, which is positioned below ridge 62 of hook 54, is forced into engagement with ridge 62, and because of resilient deformation of the plastic material, rides over ridge 62 so as to be positioned slightly above ridge 62. In this position, lever arm 68 and lock down plate 72 are not locked in the lock down position, as shown in FIGS. 1, 3 (dashed line position) and 6.

Figure 7:
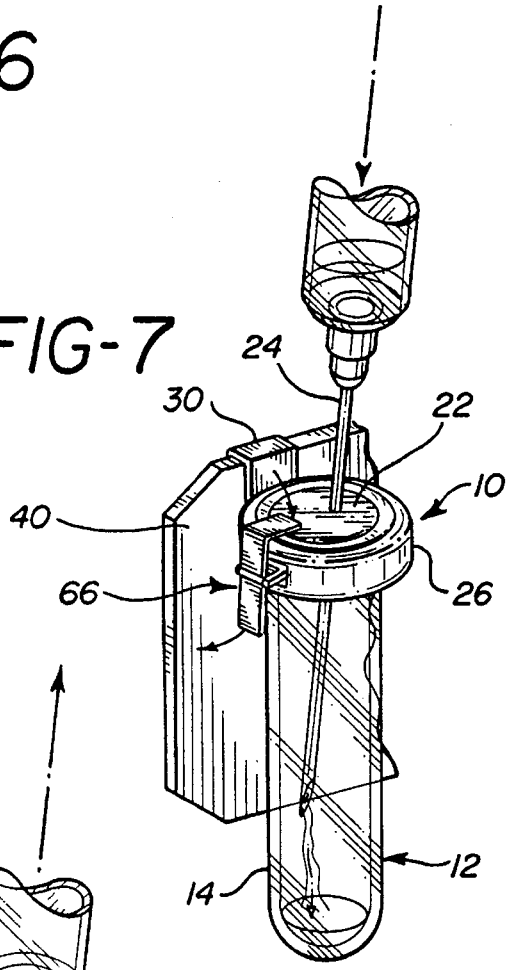
FIG. 7 is a perspective view of the test tube holder and lock down clamp of FIG. 2, with a needle inserted therein and transferring blood to the test tube.
Figure 8:
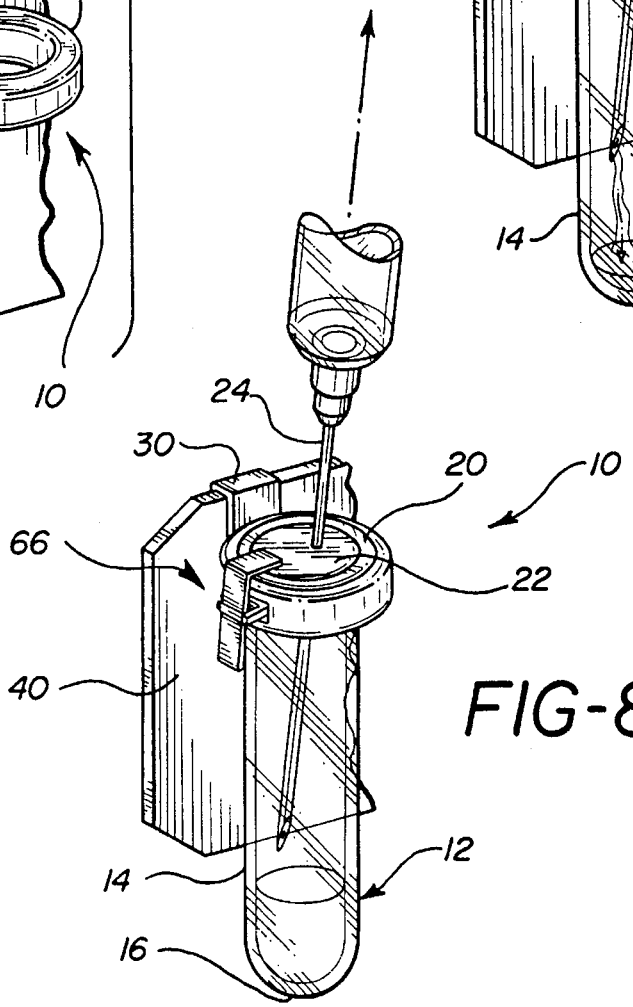
FIG. 8 is a perspective view of the test tube holder and lock down clamp of FIG. 7, with the needle being withdrawn.

In operation, a phlebotomist, doctor or nurse places a plurality of test tubes 12 in test tube holders 10 of FIG. 1. Lock down clamps 50 are then moved to their lock down positions, as shown in FIGS. 2, 3, 7 and 8. Then, the phlebotomist, doctor or nurse draws blood from the patient. Thereafter, the phlebotomist, doctor or nurse transfers the blood to respective test tubes 12, by inserting needle 24 through sealable plug 22, as shown in FIG. 7. When withdrawing needle 24, as shown in FIG. 8, because test tubes 12 are held down by lock down clamps 50, test tubes 12 are not withdrawn with needle 24.

To later remove test tubes 12, lever arm 68 is rotated in the clockwise direction in FIG. 3 from the solid line position to the dashed line position. At this time, rounded free inner edge 80 of ridge roll plate 78 rides over ridge 62, so that lever clamp 66 is no longer locked in the clamped position, and therefore, test tube 12 can be removed.

Thus, with the present invention, test tube holder 10 with lock down clamp 50 provides easy and ready removal and reinsertion of test tubes 12. In addition, when clamped, test tubes 12 are securely locked in holder rings 26. Further, with the present invention, a plurality of test tube holders 10 can be permanently affixed to a hospital bed or the like where they are readily accessible.

Although holder 10 has been shown mounted to a hospital bed 42, it will be appreciated that it may be attached to a wall, countertop, mobile wheeled unit or the like.

Having described a specific preferred embodiment of the invention with reference to the accompanying drawings, it will be appreciated that the present invention is not limited to that precise embodiment and that various changes and modifications can be effected therein by one of ordinary skill in the art without departing from the scope or spirit of the invention as defined by the appended claims.

What is claimed is:

1. A test tube holder for holding a test tube having an upper lip, comprising:

a holder having an opening therein through which the test tube can be inserted; and a lock down clamp secured to said holder and including:

a lock down member movable over said holder and over the upper lip of the test tube, and a moving assembly connected between the lock down member and the holder for moving the lock down member between a locking position in blocking relation to movement of the test tube out of said holder, and a release position out of said blocking relation.

2. A test tube holder according to claim 1, wherein said holder includes a ring having said opening therein for receiving said test tube therethrough.

3. A test tube holder according to claim 1, wherein said moving assembly includes a lever arm pivotally connected to said holder, and said lock down member is fixed to an upper end of said lever arm.

4. A test tube holder according to claim 3, wherein said lock down clamp further includes a pivoting assembly connected with said holder and to which said lever arm is pivotally connected.

5. A test tube holder according to claim 4, wherein said pivoting assembly includes two parallel, spaced apart arms extending from said holder, each said arm having a free end, and a pivot pin extending between said free ends of said arms, with said lever arm pivotally mounted on said pivot pin.

6. A test tube holder according to claim 5, wherein said holder includes an outer surface with a recess therein, and said arms are connected to said holder in said recess and extend outwardly therefrom.

7. A test tube holder according to claim 3, wherein said lock down clamp further includes a locking assembly connected with said moving assembly for releasably maintaining said lock down member in said locking position.

8. A test tube holder according to claim 7, wherein said locking assembly includes a ridge roll member secured to said lever arm, and a ridge on said holder over which said ridge roll member rides during pivoting of said lever arm, to releasably maintain said lock down member in said locking position.

9. A test tube holder for holding a test tube having an upper lip, comprising:

a holder having an opening therein through which the test tube can be inserted; and a lock down clamp secured to said holder and including:

a lock down member movable over said holder and over the upper lip of the test tube, a moving assembly connected between the lock down member and the holder for moving the lock down member between a locking position in blocking relation to movement of the test tube out of said holder, and a release position out of said blocking relation, and a locking assembly connected with said moving assembly for releasably maintaining said lock down member in said locking position.

10. A test tube holder according to claim 9, wherein said holder includes a ring having said opening therein for receiving said test tube therethrough.

11. A test tube holder according to claim 9, wherein:

said moving assembly includes a lever arm pivotally connected to said holder, and said lock down member is fixed to an upper end of said lever arm; and said lock down clamp further includes a pivoting assembly connected with said holder and to which said lever arm is pivotally connected.

12. A test tube holder according to claim 11, wherein said pivoting assembly includes two parallel, spaced apart arms extending from said holder, each said arm having a free end, and a pivot pin extending between said free ends of said arms, with said lever arm pivotally mounted on said pivot pin.

13. A test tube holder according to claim 12, wherein said holder includes an outer surface with a recess therein, and said arms are connected to said holder in said recess and extend outwardly therefrom.

14. A test tube holder according to claim 13, wherein said locking assembly includes a ridge roll member secured to said lever arm, and a ridge in said recess of said holder between said arms and over which said ridge roll member rides to releasably maintain said lock down member in said locking position.

15. A test tube holder for holding a test tube having an upper lip, comprising:

a holder ring having an opening therein through which the test tube can be inserted; and a lock down clamp secured to said holder and including:

a lock down member movable over said holder and over the upper lip of the test tube, a moving assembly connected between the lock down member and the holder for moving the lock down member between a locking position in blocking relation to movement of the test tube out of said holder, and a release position out of said blocking relation, said moving assembly including a lever arm pivotally connected to said holder, said lock down member being fixed to an upper end of said lever arm, a pivoting assembly connected with said holder and to which said lever arm is pivotally connected, and a locking assembly connected with said moving assembly for releasably maintaining said lock down member in said locking position, said locking assembly including a ridge roll member secured to said lever arm, and a ridge on said holder and over which said ridge roll member rides to releasably maintain said lock down member in said locking position.

16. A test tube holder according to claim 15, wherein said pivoting assembly includes two parallel, spaced apart arms extending from said holder, each said arm having a free end, and a pivot pin extending between said free ends of said arms, with said lever arm pivotally mounted on said pivot pin.

17. A test tube holder according to claim 16, wherein said holder includes an outer surface with a recess therein, and said arms are connected to said holder in said recess and extend outwardly therefrom.

18. A test tube holding assembly for holding a plurality of test tubes, each having an upper lip, comprising:

a frame member;

a plurality of holder rings, each having an opening therein through which a respective test tube can be inserted;

bracket means for securing each holder to said frame member; and a lock down clamp secured to each said holder, and each lock down clamp including:

a lock down member movable over the respective holder and over the upper lip of the respective test tube, a moving assembly connected between the lock down member and the respective holder for moving the lock down member between a locking position in blocking relation to movement of the test tube out of the respective holder, and a release position out of said blocking relation, and a locking assembly connected with each said moving assembly for releasably maintaining the respective lock down member in said locking position.

19. A test tube holder according to claim 18, wherein:

each said moving assembly includes a lever arm pivotally connected to said holder, each said lock down member is fixed to an upper end of a respective said lever arm, and each said lock down clamp further includes a pivoting assembly connected with the respective holder and to which the respective lever arm is pivotally connected.

20. A test tube holder according to claim 19, wherein each said locking assembly includes a ridge roll member secured to the respective lever arm, and a ridge on each said holder over which said ridge roll member rides to releasably maintain said lock down members in said locking position.

* * * * *